United States Patent [19]

Frentzel et al.

[11] 4,335,775

[45] Jun. 22, 1982

[54] ROTATABLE LOUVER HOLDER FOR LOUVERED VERTICAL VENETIAN BLIND

[75] Inventors: Kurt H. Frentzel, Zevenhoven; Herman Oskam, Bergambacht, both of Netherlands

[73] Assignee: Hunter Douglas International, N.V., Curacao, Netherlands Antilles

[21] Appl. No.: 136,953

[22] Filed: Apr. 3, 1980

[30] Foreign Application Priority Data

Apr. 6, 1979 [DE] Fed. Rep. of Germany ..... 2913888

[51] Int. Cl.[3] ..... E06B 9/38

[52] U.S. Cl. ..... 160/177; 160/176 R; 160/168 R

[58] Field of Search ..... 160/176 R, 177, 174, 160/175, 166 A, 168 R, 173, 178 R

[56] References Cited

U.S. PATENT DOCUMENTS

| | | | |
|---|---|---|---|
| 3,860,056 | 1/1975 | Bruneau | 160/176 |
| 3,996,988 | 12/1976 | de Wit | 160/168 R |
| 4,006,769 | 2/1977 | Woodle | 160/176 R |
| 4,103,727 | 8/1978 | Spohr | 160/168 R |

*Primary Examiner*—Philip C. Kannan
*Attorney, Agent, or Firm*—Pennie & Edmonds

[57] ABSTRACT

The rotatable louver holder disclosed comprises a toothed gear having a hub and arranged for axial rotation about a vertical axis and a plastic hanger member having a hook at the bottom for engaging in an opening of a louver. The hanger extends upwardly through the opening in the hub of the gear and has lateral projections engaged in diametrically opposite low points on the upper edge (guiding surface) of the hub. External force applied to the louver causes rotation of the hanger relative to the hub as the projections ride up the guiding surface toward diametrically opposite high points thereon. Stops on the hub and on the hanger limit the rotational movement; however, if a predetermined excessive amount of force is applied to the louver, the stops on the hanger are resilient enough to permit them to ride past the stops on the hole. After removal of external force applied to the louver, the projections return to the low point of the guiding surface under the influence of gravity.

10 Claims, 5 Drawing Figures

ROTATABLE LOUVER HOLDER FOR LOUVERED VERTICAL VENETIAN BLIND

BACKGROUND OF THE INVENTION

1. Field of the Invention

This invention relates to louvered venetian blinds, and more specifically to blinds having vertically arranged louvers.

A vertical venetian blind of the type to which this invention is particularly directed generally has a headrail in which several carriers are supported for movement therealong. Each carrier supports a louver for transport along the rail and includes means for rotating the louver about its vertical axis. Such means may include a drive hub of a gear wheel driven by a worm gear, which drive hub supports a louver holder for supporting and turning the louvers.

2. The Prior Art

In prior art embodiments of a vertical venetian blind of this type, there frequently exists the risk of damage or fracture to the drive mechanism, the louver holder or the louver itself, when the louver is subjected to external forces tending to rotate the louver and drive mechanism unintentionally.

BRIEF SUMMARY OF THE INVENTION

The present invention is directed to a vertically louvered venetian blind incorporating means for preventing damage to the louver, louver holder or drive mechanism, in the event external forces are applied to the louver.

To that end, the drive holder has an upper part passing through the drive hub of the gear, which upper part has lateral projections which rest upon a guide surface and are supported therefrom. The guide surface is incorporated in the upper edge of the drive hub of the gear and lateral projections of the holding portion of the louver holder rest thereon by gravity. The guide surface presents a cam tracklike shape having two opposite low points which are the normal rest position for the two diametrically opposite projections on the upper portion of the louver holder. The guide surface also has two diametrically opposite high points offset by about 90° with respect to the low points with a smoothly curving surface extending between each high point and the next adjacent low point on either side. Thus, in the event that a rotary motion is imparted to the louver from the exterior, it will rotate its holder and the projections on the upper portions of the holder will travel upwardly from the low points of the guide surface toward the high points of the guide surface. This provides a rotary motion of limited extent so that the structure may "give" in response to the externally applied force. When the force is removed, gravity acting upon the louver and its holder causes the projections on the upper portions of the holder to travel downwardly along the guide surface to come to rest once again in the low portions thereof. It will be noted that this action occurs irrespective of which direction of rotation the external force is applied.

As a further protection, the drive hub has internally thereof two stops (although one may be used if desired) which are aligned with the high points of the guide surface. These stops are internally of the hub. A pair of stops are also provided on the holder positioned to come up against the internal stops on the hub whenever sufficient external force is applied to the louver tending to rotate the same. In the event the force applied to the louver is excessive, when the stops on the holder come up against the stops on the interior of the drive hub, the stops on the holder are so arranged as to "give" inwardly to slide over and past the stops on the hub. This action permits the absorption of such an excessive force and additional "give". Stated otherwise, this permits a greater relative movement in the same direction between the louver holder and the drive hub. Plastic is preferred for all of the parts and its natural characteristics of resiliency are relied upon to provide the inward resilient movement of the stops on the louver holder when forced past the stops on the interior of the hub.

DETAILED DESCRIPTION OF THE INVENTION

General Description of the Blind

Figure 1:
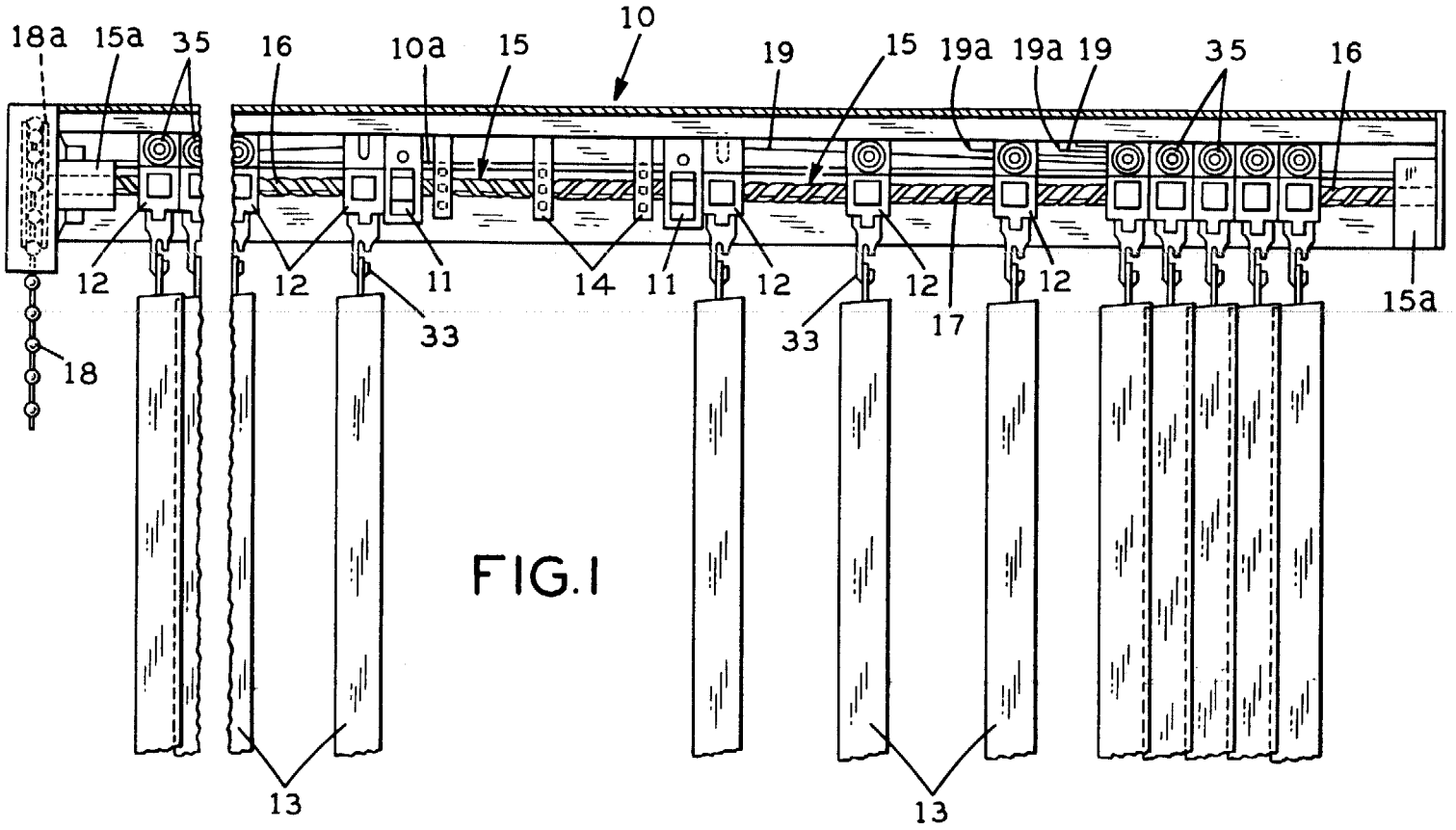
FIG. 1 shows a front view with a portion of the rail in cross-section of a louvered vertical venetian blind.
Figure 2:
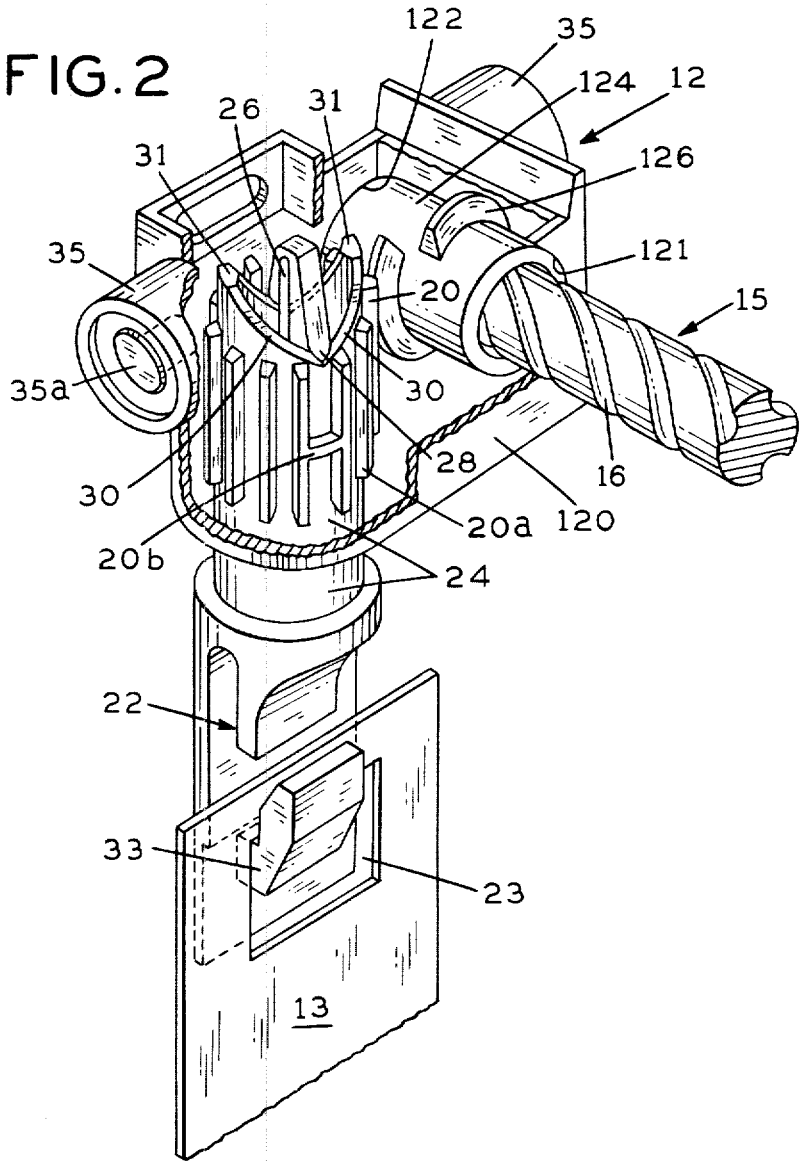
FIG. 2 shows an enlarged perspective view of a louver carrier with portions broken away to show the drive mechanism.
Figure 3:
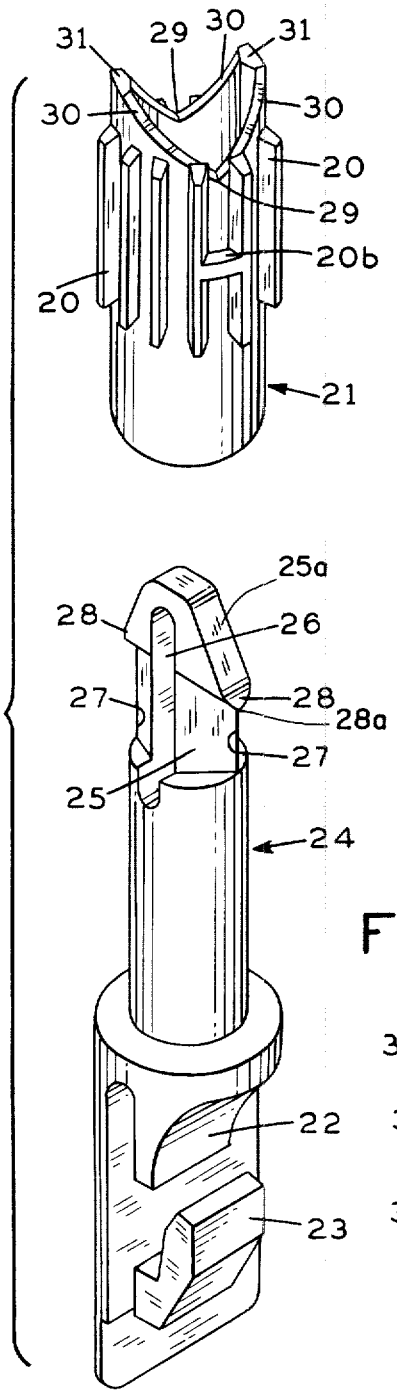
FIG. 3 shows in exploded view a louver holder and a drive hub removed from the carrier.

As shown in FIG. 1, the vertical louver venetian blind comprises a headrail 10 having on either side thereof on the inner side of the walls spaced tracks 10*a*, only one of which is shown in FIG. 1. Supported from these tracks 10*a* by rollers 35 are a plurality of carriers 12, each of which carries a louver 13 suspended therefrom by a louver holder or hook 33 extending downwardly from and mounted for rotation in the carrier 12.

As most commonly utilized in practice, the louvers 13 and their associated carrier 12 are arranged in two packs, one to the left and one to the right which, when the blind is closed, meet at the center and, when the blind is open, are packed together in two packs, one at the left end and one at the right end of the rail 10.

A drive shaft 15 is mounted within the headrail 10 by means of bearing blocks 15*a* at or adjacent the ends of the shaft 15 and also by means of intermediate support carriers 14 through which the drive shaft 15 extends. The intermediate support carriers 14 are provided in order to prevent any sagging of the drive shaft 15. The drive shaft 15 also extends through a pair of pull carriers 11, one of which is associated with each of the two packs of louver carriers 12. The drive shaft 15 has three helical grooves. The grooves 16 on one-half of the shaft 15 are opposite to the grooves 17 on the other half of the drive shaft 15. Each of the pull carriers 11 has within it means for engaging the three helical grooves 16 or 17 in the drive shaft 15 for sliding engagement along the drive shaft upon rotation thereof. As will be apparent from FIG. 1, upon rotation of the drive shaft 15, one of the pull carriers 11 (the one to the right in the figure) will move to the right away from the other pull carrier 11 (the one to the left) which will move to the left due to the different and opposite direction of the three helical grooves 16 with respect to the three helical grooves 17. Each of the pull carriers 11 is also connected securely to the first adjacent carrier 12 of its associated pack of carriers 12. Accordingly, when the pull carriers 11 move from the center toward the ends of the headrail 10, they will carry with them the first associated carrier 12 in each pack until they reach the next carrier 12 at which point they will carry both the first and second carrier 12 along with them until they reach the third carrier 12 and move it along as well and so on, picking up each carrier 12 in succession and moving it toward the end, thus opening the blind.

When the drive shaft 15 is driven in the opposite direction initially, the force applied by the drive shaft 15 will not be effective to move the pull carrier 11 but, rather, the louvers will be rotated about their vertical axes by means of the mechanism described below. When the louvers have reached the limit of their rotation about their vertical axes in this direction, further rotation about their vertical axes is prevented as described below. Shortly thereafter, and upon continued rotation of the drive shaft 15 in the same direction, the pull carrier 11 and the first louver carrier 12 to which it is secured will be moved from the end position toward the center position. When pull carrier 11 and its connected louver carrier 12 have moved together toward the center a predetermined distance, the carrier 12 will engage a projection 19*a* on a spacer member 19. Each of the louver carriers 12, except for the first ones which are connected to the pull carriers 11, has secured thereto at one end an elongated metal strip 19 which extends to and through the next adjacent louver carrier 12 toward the center. This elongated metal spacer strip 19 determines the spacing between adjacent louver carriers 12 and, thus, between the louvers 13. The spacer 19 extends through in sliding relationship with the next adjacent carrier 12 that is on that side toward the center. When a carrier 12 reaches the end of the spacer 19, it engages the up-turned projection 19*a* and, thus, pulls the next succeeding carrier 12 along, which next succeeding carrier 12 is fixed to the opposite end (opposite projection 19*a*) of the spacer member 19. In this way, the blind, when closed, insures that the individual louvers 13 are evenly spaced while at the same time permitting them to pack together at the ends when opened.

At one end of the shaft 15 is a bead chain pulley 18*a* secured thereto and around which is engaged a bead chain 18 for operating the blind by rotating the drive shaft 15.

The Louver Carrier and Drive

As shown in FIGS. 2 through 5, the louver carrier 12 is supported for rolling transport along tracks 10*a* by means of rollers 35 loosely mounted on stub shafts 35*a* integral with the housing 120 of the carrier 12. The drive shaft 15 extends through openings 121, 122 provided in the opposite side walls of the housing 120 and has frictionally engaged thereabout a worm gear 124 having a single worm thread 126 engaged with the teeth 20*a* on a drive hub or gear 20 having a generally hollow cylindrical hub 21.

Two juxtaposed stops 20*b* and 20*c* are provided each one between two adjacent teeth at half the tooth-height. Because of the presence of the stops 20*b*, 20*c*, the louver 13 may not be rotated 360°. Rather, the limit of rotation of the louver 13 is chosen to provide overlap of the louvers at the limit of rotation in either direction without excessive forces being applied from one louver to the next. The amount of rotation of the louvers 13 about their vertical axes may advantageously be of the order of 90° in either direction from a point midway between the stops 20*b* and 20*c*.

A louver holder, generally indicated at 22, has adjacent its lower end an upwardly opening hook 33 with which a louver 13 is engaged by means of an opening 23 in the upper portion thereof. The upper portion of louver holder 22 has a reduced cylindrical shape 24 which fits within the hollow hub 21 in the assembled state. Extending upwardly from the cylindrical portion 24 are two spaced arms 25 arranged diametrically opposite to each other and joined at their upper ends by a generally rounded bracket 25*a*.

Along at least a substantial portion of their length, the arms 25 have a triangular cross-section with the base of the triangular cross-section of one arm 25 facing the base of the triangular cross-section of the other arm 25 and with an apex 27 on each arm 25 facing radially outwardly of the vertical axis of the holder 22. These apices 27 serve as stops as explained below.

At their upper ends, the arms 25 each have a radially outwardly extending projection 28 in alignment with the associated stops 27. Each of the outward projections 28 has a generally downwardly extending wedge-like form terminating on the underside in an edge 28*a* extending radially of the axis of the holder 22 and generally in alignment with the stops 27.

Figure 4:
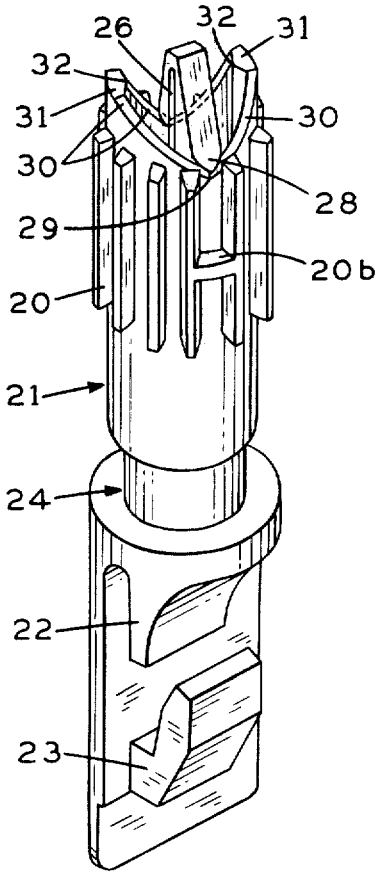
FIG. 4 shows the parts of FIG. 3 in assembled condition.
Figure 5:
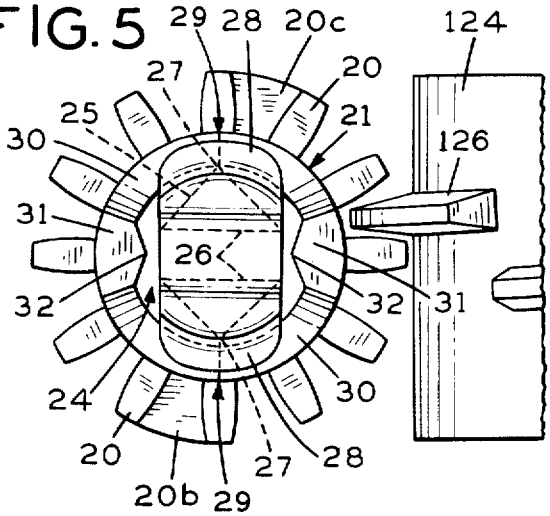
FIG. 5 shows a plan view of FIG. 4 but without the lower part of the louver holder.

Due to the inherent resiliency of the plastic used to form the holder 22 and the gear 20, and due also to the slot 26 between the arms 25, the arms 25 may be readily pressed together sufficiently to insert the projections 28 upwardly through the internal space within hub 21 of gear 20. After having passed upwardly through the interior of the hub 21, the arms 25 will spring back and the parts will assume the position shown in FIG. 4. In the assembled position as shown in FIG. 4, it will be seen that the upper edge of the hub 21 has a cam track-like guide surface 30 having two diametrically opposite low points 29 and two diametrically opposite high points 31 offset by 90° relative to the low points. In the normal position of the blind, as shown in FIG. 4, the bottom edge 28*a* of the projections 28 rests at the very bottom of the lowest points 29 of the guide surface 30.

Associated with the high points 31 are inwardly projecting stops 32 projecting inwardly of the hub 21. The stops 32 are generally triangular in cross-section and have shapes and dimensions that cooperate with the stops 27 and the triangular shape of the arms 25 in a manner more fully described below. The stops 32 extend inwardly toward the axis of the holder 22 to a point closer to the axis than are the stops 27. Upon rotation of the holder 22, the stops 27 will engage the stops 32.

Operation

In the position shown in FIG. 4, which is the normal position of the holder 22 and the gear 20, rotation of the drive shaft 15 will effect rotation of the worm gear 124 and its worm 126. In turn, rotation of the worm 124 effects rotation of the gear 20 by engagement between the worm 126 and teeth 20*a*. In this manner, rotation of the louver about its vertical axis in either direction is effected between the limits imposed by the stops 20*b* and 20*c*.

When one of the end faces of the worm 126 comes up against one of the stops 20*b* or 20*c*, further rotation of the louver about its vertical axis is prevented. Shortly thereafter, a clutch mechanism (not shown herein) within the pull carrier 11 will cause the pull carrier to move along the drive shaft 15 and rail 10 in one direction or the other to open and close the blind as above described. At any time after transport of the pull carrier 11 along the drive shaft 15 has begun, reversing rotation of the drive shaft 15 will stop such transport along the shaft and commence rotation of the louvers about their vertical axes. Again, this rotation about the vertical axes can be continued until one end of the worm 126 comes up against one of the stops 20*b*, 20*c*, whereupon transport of the pull carrier 11 in the opposite direction will be commenced. Accordingly, the blind may be positioned fully opened, fully closed or at any position intermediate these two limits. Also, at any position of the blind, the orientation of the louvers about their vertical axes can be adjusted.

At any time, whether or not the louver is stationary, is being rotated or is being transported, if an external rotational force is exerted on the louver, this force is transmitted to the louver holder 22 which can initially rotate relative to the hub 21 until the stops 27 and 32 are in contact with one another. During this rotation, the projections 28 and the edges 28*a* move upwardly along the rising portion of the guide surface 30. It will be appreciated that this rotary motion of the louver holder 22 and its louver 13 effects a small upward lifting of the louver 13 and holder 22 as well as limited rotational movement.

If the externally exerted force tending to rotate the louver 13 should reach an unduly high value, the stops 27 and 32 are shaped to pass by one another. More particularly, the sloped facing surfaces of the stops 27 and 32 effect sufficient inward flexing of the arms 25 as to permit the stops 27 to pass by the stops 32. Thus, an overload protection is achieved which prevents any damage to the louver 13, the holder 22, the gear 20, or any of the other parts of the mechanism including worm gear 124, drive shaft 15 and housing 120.

If the louver holder 22 has been forced by the externally applied force to a position in which the stops 27 and 32 do not pass by one another, then, upon removal of the external force, gravity will cause the holder 22 to glide back down to its original position. The same occurs if the stops 27 have passed the stops 32 twice (or an even number of times). If, on the other hand, the stops 27 have passed by the stops 32 once (or an odd number of times), then, in that event, gravity will cause the louver holder 22 to slide down into a position 180° removed from its original position which will, however, be in the same plane, although the louver will have its opposite side facing outwardly.

External forces may inadvertently be applied to the louvers in a number of ways, such as inadvertently inserting the hand of an operator between adjacent louvers, hitting the louvers with any solid object or, even, a strong gust of wind. In all cases, the louvers may turn, thus absorbing the force without damage and then automatically return to their desired position.

We claim:

1. A support for supporting a louver from the headrail of a vertically louvered venetian blind comprising a holder, means on said holder for engaging one end of a louver, drive means for rotating said holder and its supported louver about a vertical axis, said drive means including a hub, the axis of said hub extending vertically, said hub having an upper edge, said upper edge comprising a guide surface, said guide surface having at least one low point, a portion of said holder resting in a low point of the guide surface during normal operation of said blind, said holder being free to move with respect to said hub upon an external force being applied to said louver, movement of said holder with respect to said hub when an external force is applied to said louver effecting movement of said portion of said holder along said guide surface to a higher portion thereof, and said holder being movable relative to said hub under the force of gravity when the external force is removed from said louver to effect return of said portion of said holder to a low point on said guide surface, the support being further so constructed that said hub has a stop, said stop being positioned at a point removed from said low point, said holder including a cooperating stop positioned to engage the stop on said hub after a predetermined amount of movement of said holder relative to said hub under external force applied to said louver, said stops interreacting with each other resiliently to permit the stop on said holder to pass by the stop on said hub when the external force applied to said louver exceeds a predetermined magnitude.

2. The support of claim 1, in which said hub has an opening extending therethrough, a part of said holder extending upwardly through said opening, said portion of said holder that rests in said low point being a lateral projection from the part of said holder extending through said hub.

3. The support of claim 2, in which said guide surface has a high point and in which the stop on said hub is in substantially radial alignment with said high point.

4. The support of claim 3, in which the stop of said hub extends axially inwardly of said opening.

5. The support of claim 4, in which the stop on said holder has a triangular shape in horizontal cross-section, one apex of said triangle extending radially outwardly, one sloped side of the triangle facing generally toward the stop on said hub, the stop on said hub having a generally triangular horizontal cross-section with one apex extending radially inwardly toward the axis of the hub, one sloped surface of the triangle of the stop on said hub facing generally toward the like surface of the stop on said holder, the part of said holder within said hub being flexible, said mutually facing surfaces on said stops becoming engaged upon the application of an external force of sufficient magnitude to said louver, said mutually facing surfaces when engaged and under the pressure of a predetermined excessive force applied to said louver effecting flexing of the stop on said holder to permit it to pass by the stop on said hub and continue its movement in the same direction.

6. The support of claim 5, in which said holder has two diametrically opposite projections, said hub has two diametrically opposite low points, said projection in the normal position of operation of the blind each resting in a low point, the dimension from the outermost point of one projection to the outermost point of the other projection being greater than the diameter of said opening, and said projections being flexibly movable toward each other to an extent sufficient to permit them to pass through said opening, the flexibility of said projections being such as to return them to their normal position after passage through said opening.

7. The support of claim 6, in which each of said projections has a wedge shape with the edge of said wedge facing downwardly and extending radially of the axis of said holder and said hub.

8. The support of any one of the preceding claims, in which said hub has gear teeth on the outer surface thereof, said drive means includes a drive shaft and a worm, and said worm being engaged with the teeth on said hub, rotation of said drive shaft effecting rotation of said hub, and said hub effecting rotation of said holder through the mutual engagement of a low point on said hub and a projection on said holder.

9. A support for supporting a louver of a vertical venetian blind comprising a toothed gear, said gear having a hollow hub, said gear being mounted for rotation about a vertical axis, a holder, one end of said holder being engaged with an end of a louver for supporting the same, said holder having a central portion extending through said hub, said holder having an upper portion, the upper edge of said hub comprising a guiding surface, said guiding surface having two diametrically opposite low points and two diametrically opposite high points, said high points being 90° removed circumferentially of the hub from said low points, said upper portion of the holder having two diametrically opposite projections resting upon the low points of said guide surface in the normal position of said louver, and rotation of said gear effecting rotation of said holder and said louver about said vertical axis through the mutual engagement of said projections in said low points.

10. The holder of claim 9, in which at least a part of said central portion of said holder comprises two arms spaced apart with a slot therebetween and each of said projections extends radially outwardly from one of said arms, the material of said arms being resilient, said arms being movable together a sufficient distance to permit said projections to be passed through the opening in said hub, and the resiliency of said arms being sufficient to position said projections on said low points outwardly of said opening after passage of said projections through said hub.

* * * * *